US006164178A

United States Patent [19]

Iattoni et al.

[11] Patent Number: 6,164,178

[45] Date of Patent: Dec. 26, 2000

[54] METHOD AND APPARATUS FOR CUTTING AND REMOVING PATTERNS FROM A FABRIC PLY MAT

[75] Inventors: Vitaliano Iattoni, Pianoro; Fausto Mazza, Bologna, both of Italy

[73] Assignee: Omnitex S.r.l., S. Lazzaro di Savena, Italy

[21] Appl. No.: 08/965,373

[22] Filed: Nov. 6, 1997

[30] Foreign Application Priority Data

Nov. 8, 1996 [IT] Italy ..... BO96A0567

[51] Int. Cl.[7] ..... B26D 7/20

[52] U.S. Cl. ..... 83/941; 83/154; 83/89

[58] Field of Search ..... 83/151, 152, 154, 83/155, 936, 940, 941, 84, 85, 86, 88, 89, 90, 91, 96, 681, 32, 40, 41

[56] References Cited

U.S. PATENT DOCUMENTS

| | | | |
|---|---|---|---|
| 1,846,635 | 2/1932 | Finley | 83/56 |
| 2,600,834 | 6/1952 | Blair | 83/40 |
| 3,238,826 | 3/1966 | Crispe | 83/155 |
| 3,693,387 | 9/1972 | Murdock et al. | 83/100 |
| 3,805,650 | 4/1974 | Pearl | 83/56 |
| 3,881,379 | 5/1975 | Stumpf . | |
| 4,079,644 | 3/1978 | Hoke et al. | 83/155 |
| 4,134,318 | 1/1979 | Rader et al. | 83/94 |
| 4,212,213 | 7/1980 | Wilfelsperger et al. | 83/155 |
| 4,247,092 | 1/1981 | Dwyer . | |
| 4,448,099 | 5/1984 | Kuroda et al. | 83/151 |
| 4,524,658 | 6/1985 | Focke et al. | 83/152 |
| 4,711,019 | 12/1987 | Albeck et al. | 83/56 |
| 5,092,829 | 3/1992 | Gerber | 83/941 |
| 5,174,183 | 12/1992 | Werner | 83/936 |
| 5,189,934 | 3/1993 | Davidson et al. | 83/151 |
| 5,189,936 | 3/1993 | Gerber et al. | 83/409 |

FOREIGN PATENT DOCUMENTS 8 810 228 12/1988 WIPO .

*Primary Examiner*—M. Rachuba
*Assistant Examiner*—Kim Ngoc Tran
*Attorney, Agent, or Firm*—Guido Modiano; Albert Josif; Daniel O'Byrne

[57] ABSTRACT

A method for cutting a mat of plies of fabric in order to facilitate the removal of stacks of cut pattern pieces, which consists of the fact that in addition to perimetrically cutting the contours of the various pattern pieces, additional cuts are formed in the mat which connect the various contours to each other and to the edges of the mat, the cuts reducing the residues of the mat to small and mutually separate portions. The machine for automatically removing the stacks from a cutting table has a supporting framework which is provided with elements for fixing to the table; a conveyor belt for removing the pieces, which is arranged at the base of the framework directly to the side of the table; grippers for gripping and releasing the stacks which are associated with movement elements for producing lifting and lowering and translatory motion along a direction which is parallel to the belt, the movement elements being controlled by a central control and actuation unit which can be programmed according to the shape and arrangement of the stacks in the mat.

12 Claims, 7 Drawing Sheets

FIG.2
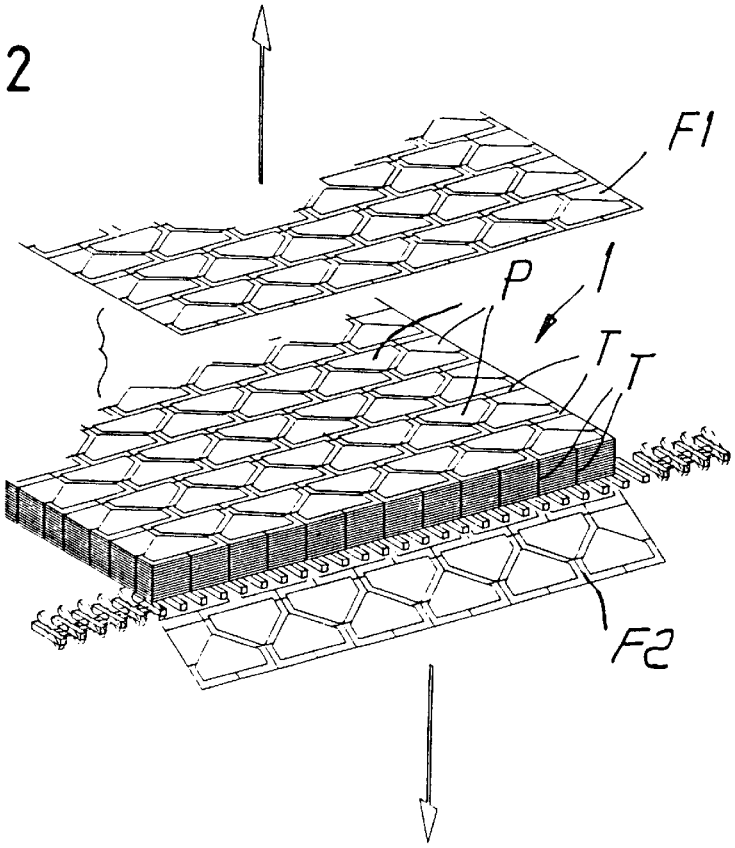
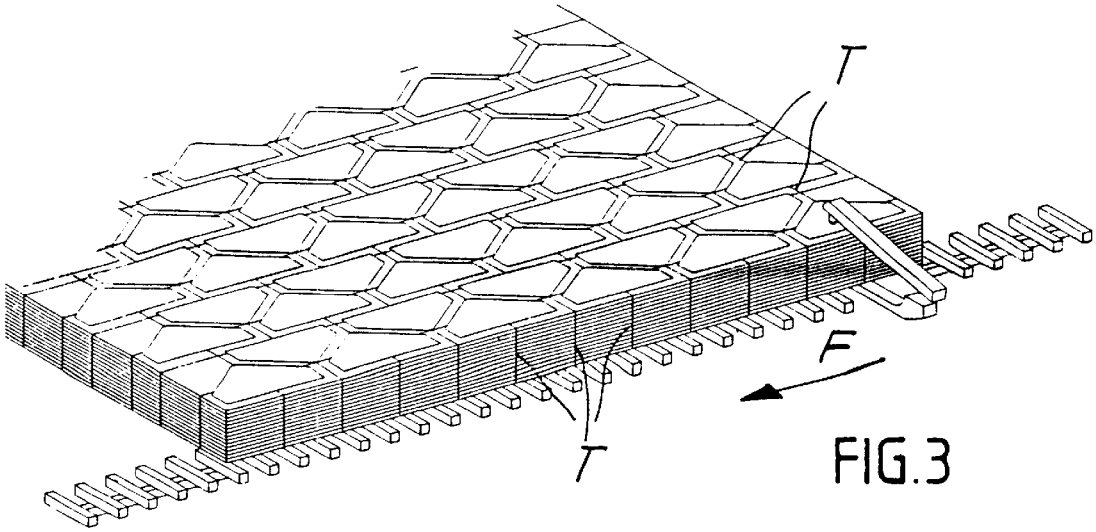
FIG.3

METHOD AND APPARATUS FOR CUTTING AND REMOVING PATTERNS FROM A FABRIC PLY MAT

BACKGROUND OF THE INVENTION

The present invention relates to a method for cutting a mat of plies of fabric in order to facilitate the removal of stacks of cut pattern pieces and to a machine for automatically removing the stacks from a cutting table.

In the particular field of the cutting of pattern pieces of cloth for making items of clothing of any kind, cutting tables are currently used constituted by a platform on which a stack of a plurality of superimposed individual cuts of cloth, known as mat, is arranged; a film made of a material such as impermeable plastics is placed on the mat and intense suction is applied from below, compressing and packing the mat on the table: then a blade descends which is actuated so as to oscillate vertically in order to cut the mat of fabrics and so as to move on the plane along x-y coordinated axes in order to follow the contour of the individual pattern pieces to be cut.

The cutting operations are performed automatically and are controlled by an electronic computer, which is appropriately programmed in each instance with the data related to the contours to be cut and to their distribution in the mat.

Once the pattern pieces have been cut, it is necessary to remove the individual stacks of cut pieces from the mat; this operation is currently performed manually, with a considerable expenditure of time and labor: it has been observed, for example, that three or four people are needed in order to remove the cut stacks in the time required by an operator to perform the cutting operation; moreover, whereas cutting requires simply monitoring by personnel and interventions only in case of malfunctions and for the operations for loading the mat, removal of the stacks requires direct manual interventions in positions which are also awkward to reach.

Removal of the stacks of cut pieces is also hindered by the fact that the mat can be even considerably thick and that it is necessary to act from above: removal difficulties increase in the presence of small pieces having a reduced area.

SUMMARY OF THE INVENTION

The aim of the present invention is to obviate the mentioned drawbacks of conventional devices, i.e., to provide a method for cutting a mat of plies of fabric which allows to facilitate the removal of stacks of cut pattern pieces and to provide a machine which is capable of automatically removing the stacks from a cutting table.

An object of the present invention is to provide a cutting method and a machine for automatically removing the stacks which can be adopted in conventional cutting tables.

Within the scope of this aim, another object of the present invention is to achieve the above aim with a structure which is simple, relatively easy to provide in practice, safe in use, effective in operation, and has a relatively low cost.

This aim, these objects and others which will become apparent hereinafter are all achieved by the present method for cutting a mat of plies of fabric in order to facilitate the removal of stacks of cut pattern pieces, characterized in that in addition to perimetrically cutting the contours of the various pattern pieces, additional cuts are formed in the mat which connect the various contours to each other and to the edges of the mat, said cuts reducing the residues of the mat to small and mutually separate portions.

The machine for automatically removing the stacks from a cutting table according to the present method is characterized in that it comprises: a supporting framework, which has elements for fixing to said table; a conveyor belt for removing the pattern pieces, which is arranged at the base of said framework directly to the side of said table; means for gripping and releasing the stacks, which are associated with means for lifting, lowering and shifting in a direction which is parallel to said belt; said means being controlled by a central control and actuation unit which can be programmed in relation to the shape and arrangement of the stacks in the mat in order to place the grip means at each individual stack, grip the stack, lift it, turn the grip means so that the grip front is parallel to said belt, and then release said stack onto the belt.

BRIEF DESCRIPTION OF THE DRAWINGS

Further characteristics and advantages of the present invention will become apparent from the following detailed description of a preferred but not exclusive embodiment of a machine for automatically removing the stacks from a cutting table according to the present invention, illustrated only by way of non-limitative example in the accompanying drawings, wherein:

FIGS. 2, 3, 4 and 5 are schematic perspective views of the sequence of the various removal steps that affect a mat to which the method has been applied;

DESCRIPTION OF THE PREFERRED EMBODIMENTS

Figure 1:
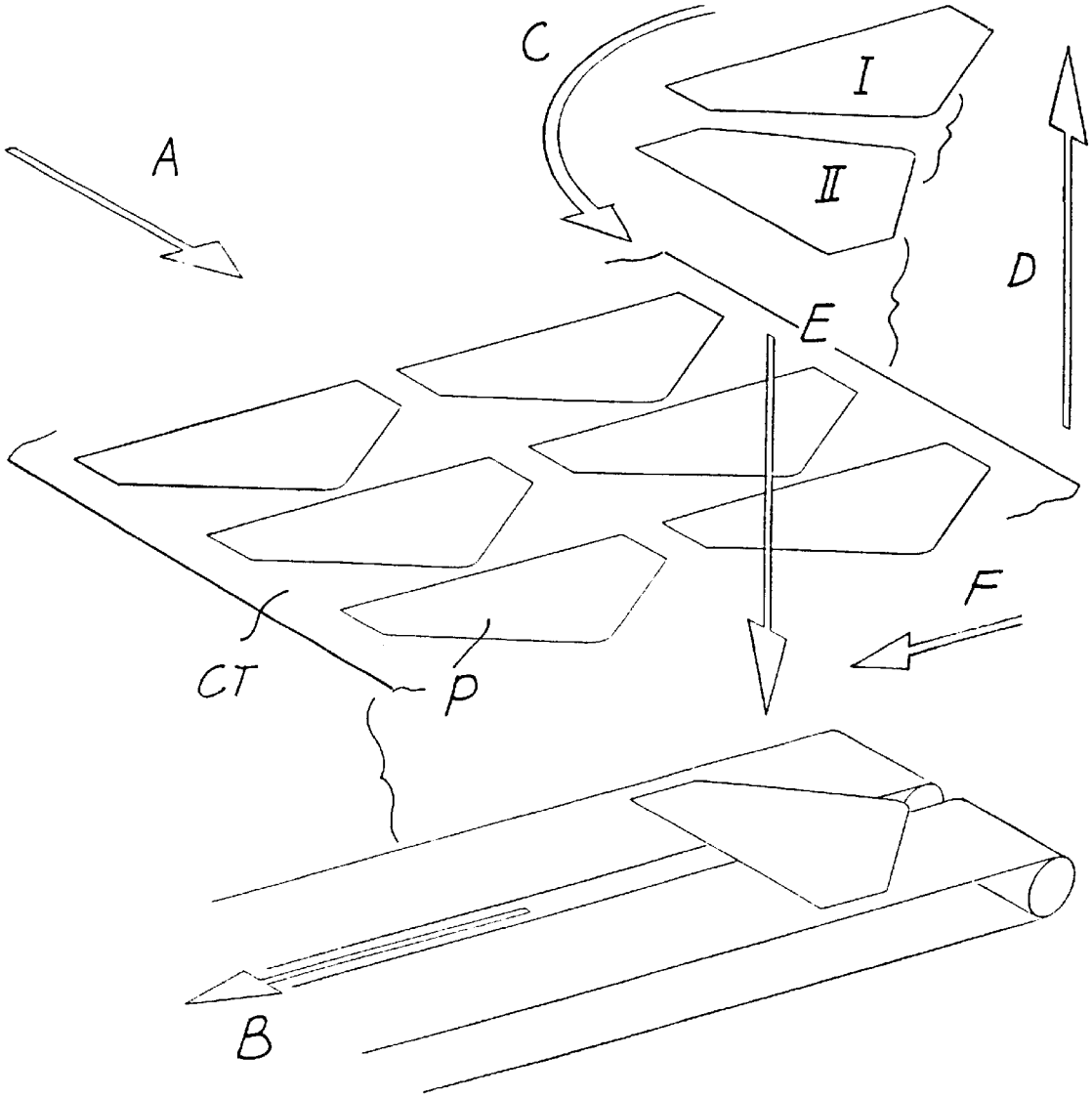
FIG. 1 is a schematic perspective view of the sequence of the operating steps of a machine for automatically removing the stacks of cut pattern pieces according to the present invention.

With particular reference to the above figures, the reference numeral 1 generally designates a mat of plies of fabric which has been cut appropriately so as to facilitate the removal of stacks P of cut pattern pieces according to the present invention.

In compliance with the method according to the present invention, additional cuts T are formed in the mat 1, in addition to the perimetric cuts of the contours of the various pattern pieces, which are shown schematically in the figure as irregular pentagons but in practice have the shape required to make items of clothing; said additional cuts T connect the various contours to each other and to the edges of the mat, reduce the residues of the mat to small mutually separated portions and allow to remove the stacks frontally: advantageously, the cuts T are distributed in an orderly fashion in a grid and there is also provided a perimetric cut which allows to recover the covering film.

The reference numeral 2 generally designates a machine for automatically removing the stacks from a conventional cutting table (CT); said cutting table is provided with means for the frontal translatory motion of the mat which are suitable to make the mat advance stepwise in the direction of the arrow A as the stacks P are removed.

The machine 2 comprises a supporting framework 3 which is constituted by posts 4, longitudinal members 5 and cross-members 6 which are mutually welded at right angles to each other; said framework is provided with elements for fixing to the cutting table.

A conveyor belt 7 is mounted at the base of the supporting framework 3 and to one side of the table in order to remove the pattern pieces in the direction of the arrow B; the belt 7 is of the kind constituted by two separate belts 8*a*, 8*b* which are mutually spaced and are wound around two parallel and horizontal rollers 9*a*, 9*b* which are associated with an actuation assembly, not shown in the figure, for the advantageously stepwise removal of the stacks P.

The reference numeral 10 generally designates means for gripping and releasing the stacks, which are preferably associated with means 11 for rotating about a vertical axis (arrow C), with lifting and lowering means 12 (arrows D and E), and with means 13 for translatory motion (arrow F) in a direction which is parallel to the belt 7: in the figure, as regards the rotation means 11, only the shaft about which the grip means 10 rotate has been shown; as regards the lifting and lowering means 12 and the translatory motion means 13, four vertical fixed guides 14*a*, 14*b*, 14*c* and 14*d*, two vertically movable longitudinal members 15*a*, 15*b* mutually connected by a horizontal guide 16, along which a sliding block 17 is fitted so that it can slide, have been shown.

Figure 4:
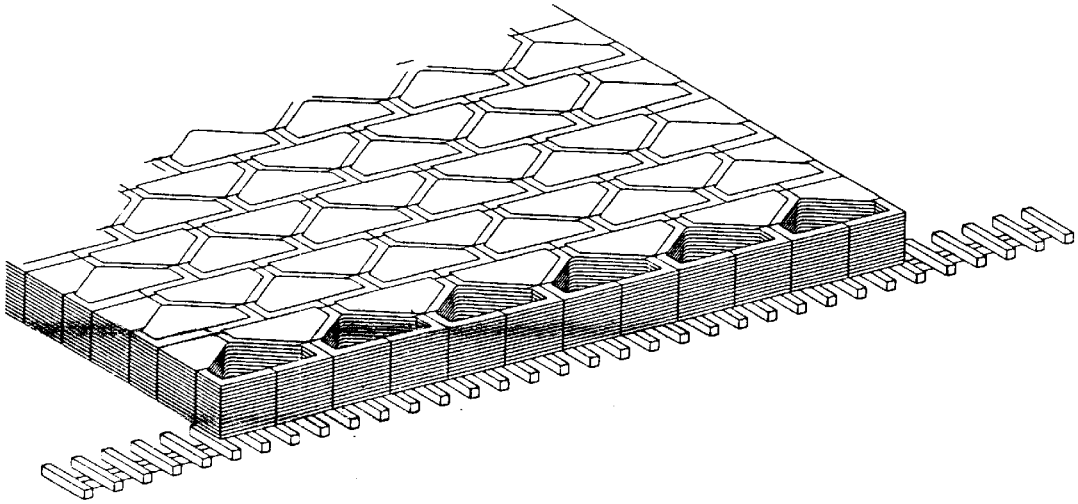
Figure 5:
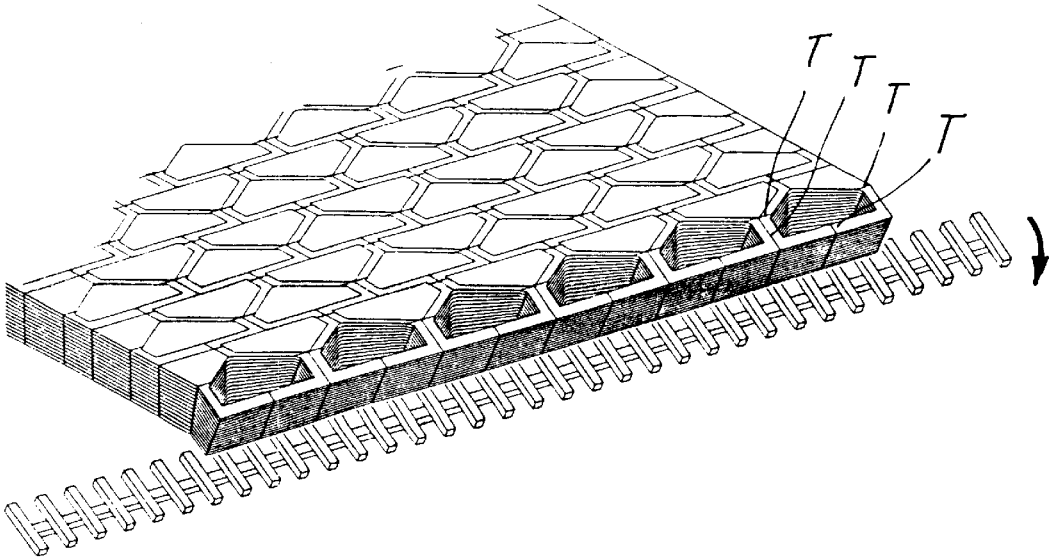
Figure 6:
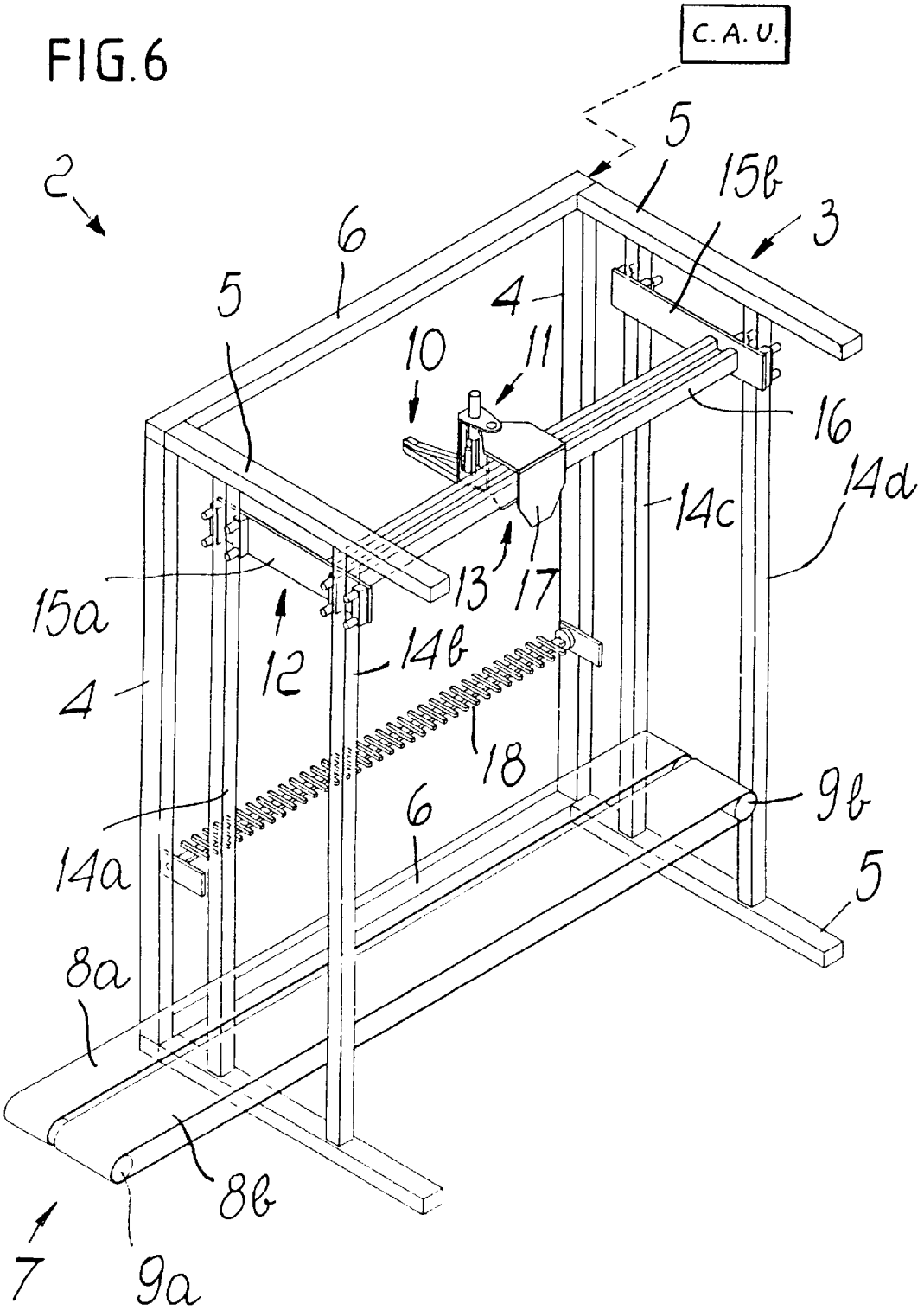
FIG. 6 is a schematic perspective view of the machine according to the invention.

A longitudinal grid 18 of mutually parallel and spaced rulers is installed at the outlet of the cutting table and is associated with elements for oscillating about a longitudinal axis to lower and then discharge the mat portions which gradually become waste (FIGS. 4 and 5).

Figure 8:
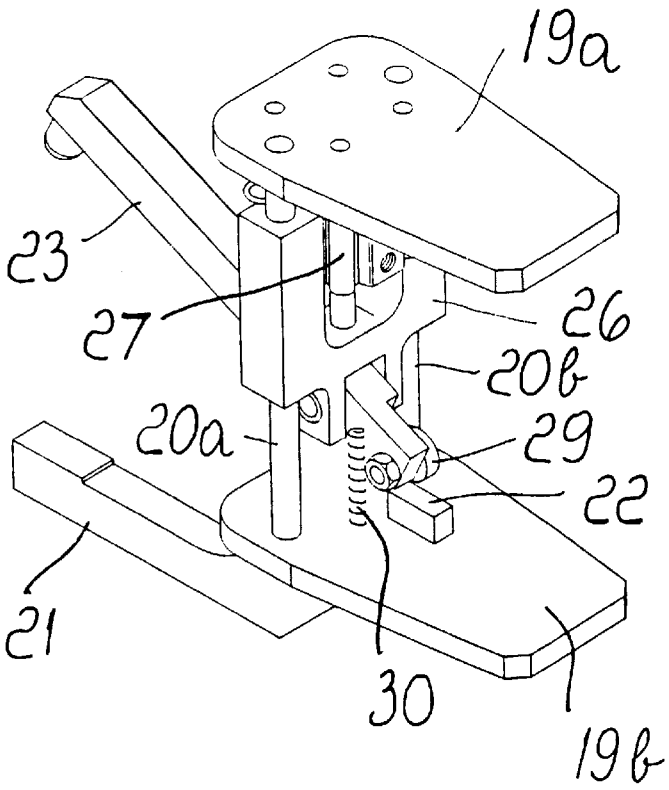
FIGS. 7 and 8 are perspective views of operating steps for gripping and releasing the gripper-type grip means of the machine.
Figure 7:
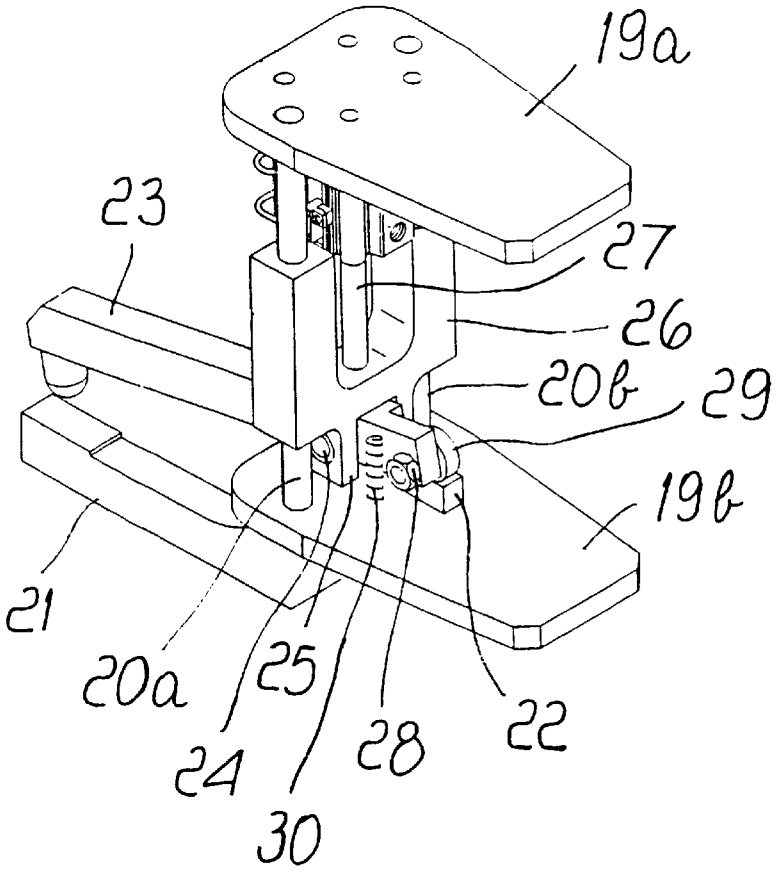

The grip means 10, in the embodiment shown in FIGS. 7 and 8, are of the gripper type for frontally gripping the stacks; said gripper means, in a preferred embodiment, comprise two horizontal plates 19*a*, 19*b* which are mutually connected by two parallel vertical posts 20*a*, 20*b*; the end of a lower claw 21 is fixed below the plate 19*b* and an abutment 22 for the rear end of the upper claw 23 is mounted above; in a median position, the claw 23 is articulated, by means of a horizontal pivot 24, to a lower fork 25 of a sliding block 26 which is actuated so that it can slide vertically along the posts 20*a*, 20*b* by a jack with a vertical axis, the moving stem 27 whereof has been shown; at the rear end of the claw 23 there is provided a bearing 29, which is mounted by means of a bolt 28 and rests on the abutment 22, as well as a centering element for the top of a helical compression spring 30: the actuation of the moving stem 27 of the jack causes the lifting or lowering of the sliding block 26 and therefore the respective opening or closure of the gripper on the stack.

Figure 9:
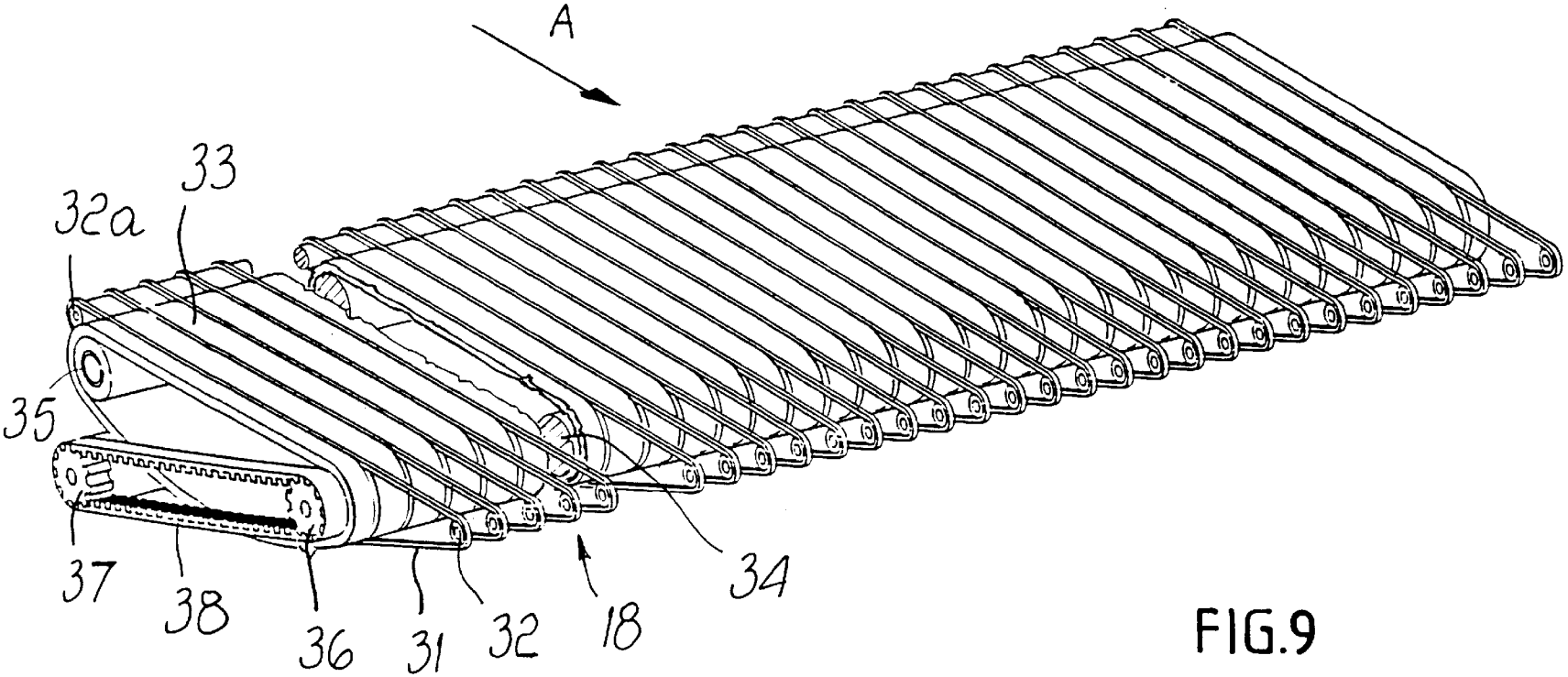
FIG. 9 is a schematic perspective view of the assembly for inserting the mat in the machine according to the invention.
Figure 10:
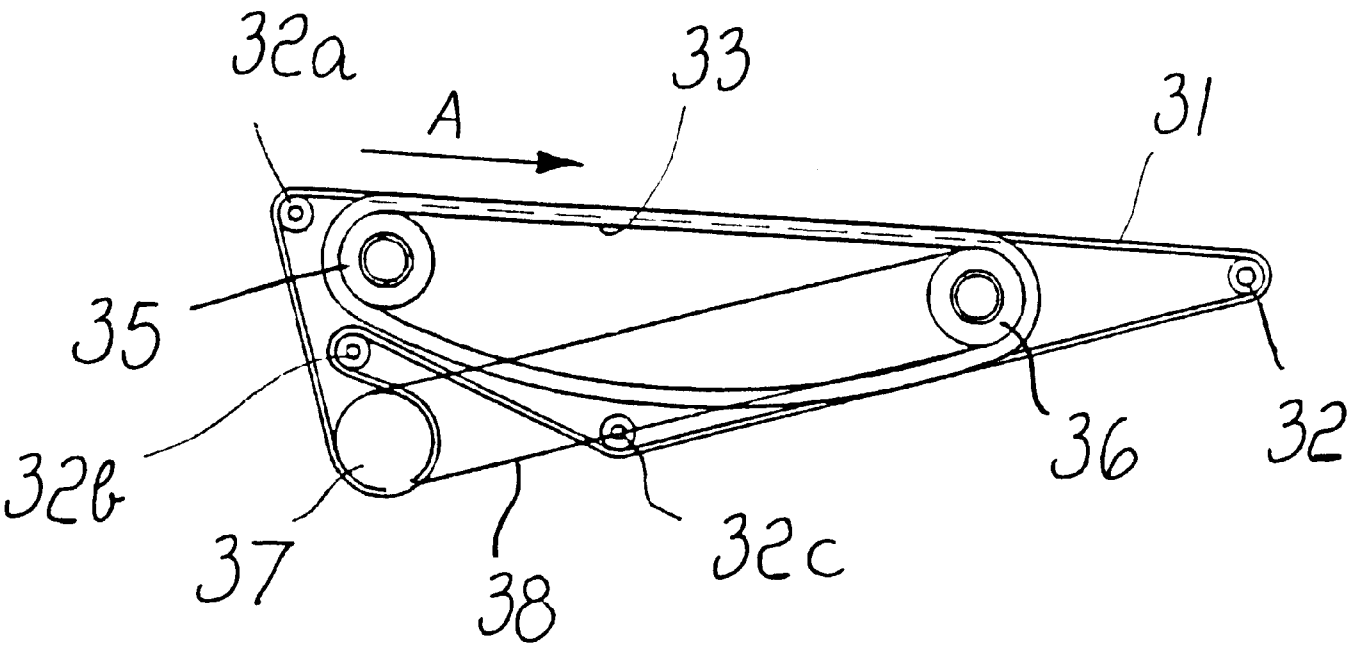
FIG. 10 is a schematic side view of the assembly of FIG. 9.

The claws 21–23 are meant to penetrate without interference between the parallel rulers of the longitudinal grid 18 (FIG. 9) and between the two belts 8*a* and 8*b* in order to easily remove and deposit the stacks.

The grip means 10 may also be of the top-suction type.

FIG. 2 illustrates, in its upper portion, the sheet F1 and, in its lower portion, the sheet F2, which are made of paper or of a material such as plastics and are required to cut the mat; advantageously, the sheets F1 and F2 are eliminated before removing the stacks P.

All the described functional means are controlled by a central control and actuation unit (C.A.U.), which can be programmed according to the shape and arrangement of the stacks in the mat in order to place the grip means at each individual stack, grip the stack, lift it, rotate the grip means so that the grip front is parallel to the belt 7 and then release said stack onto the belt.

Necessarily, a point for gripping the stack of pattern pieces is defined for each one of the contours of the various pieces: the data related to said cuts, which are distributed in a grid pattern, and to said stack grip points are processed automatically, starting from the data defined for controlling the cutting elements of a conventional mat cutting machine, and produce a sequence of coordinated instructions for controlling said automatic mat cutting machine and the machine according to the present invention.

In other words, the file of the cutting program is processed directly and is supplemented with the data for cutting along the grid and with the data of the stack grip points.

It has been observed that at the outlet of the cutting table the longitudinal grid 18 of mutually parallel and spaced rulers does not allow to make the mat advance correctly in the direction of the arrow A: this advancement is in fact achieved by means of a conveyor belt which is wound on two co-planar rollers which are orientated parallel to the arrow F, and on which the mattress, especially the last part thereof, tends to slip.

In order to obviate this drawback, the rulers of the longitudinal grid 18 have been provided with a plurality of freely rotating end pulleys 32 which are coaxial along a horizontal axis and on which respective secondary belts 31 are wound, closed in a loop and wound on respective pulleys 32*a*, 32*b*, 32*c*.

The reference numeral 33 designates the end portion of the mat conveyor belt; said belt is wound on a motorized roller 34 and a guiding roller 35 and is constituted by a plurality of strips which are rigidly coupled to each other and between which incisions are formed in which the secondary belts 31 are recessed: the motorization of the roller 34 is advantageously achieved by means of a coupling with sprockets 36–37 and a toothed belt 38.

A space remains between each one of the pulleys 32 and the adjacent pulley, and the lower claw 21 of the means 10 for gripping the stacks P can be inserted in said space.

It has thus been shown that the present invention achieves the intended aim and objects.

The invention thus conceived is susceptible of numerous modifications and variations, all of which are within the scope of the inventive concept.

All the details may furthermore be replaced with other technically equivalent ones.

In practice, the materials employed, as well as the shapes and the dimensions, may be any according to the requirements without thereby abandoning the scope of the protection of the appended claims.

What is claimed is:

1. In combination, a cutting machine for cutting a mat of piles of fabric, and a machine for automatically removing stacks of pattern pieces cut from said mat of piles of fabric supported on a cutting table of said cutting machine having an outlet edge at which the cut mat is fed, said cutting machine being adapted to perimetrically cut contours of various pattern pieces on the mat of piles of fabric supported on said cutting table to form mutually separate stacks of cut pattern pieces which are mutually separate from each other and which are also separate from a residual portion of the mat, and said cutting machine being further adapted to form additional cuts in the mat which extend in the residual portion of the mat between the contours of said mutually separate stacks of cut pattern pieces to connect the mutually separate stacks of cut pattern pieces to each other by means of said additional cuts and to edges of the mat such that said additional cuts reduce said residual portion of the mat to small and mutually separate residual portions for facilitating removal of said stacks of cut pattern pieces from the mat, and the cutting machine being adapted to move the mat in an advancement direction towards said outlet edge of said cutting table such that said stacks of cut pattern pieces exit from said cutting table at said outlet edge of said cutting table, the machine for automatically removing the stacks of pattern pieces comprising:

a supporting framework arranged adjacent the outlet edge of said cutting table;

a conveyor belt arranged at a base of said framework for removing the cut pieces;

gripping means for gripping the cut stacks which have been fed at said outlet edge of said cutting table simultaneously at top and bottom surfaces of said cut stacks and for removing the cut stacks from the mat of piles of fabric and for releasing the removed cut stacks on said conveyor belt, said gripping means being supported by said framework such that said gripping means is movable up and down in a vertical direction and back and forth in a horizontal direction extending parallel to the extension of said outlet edge of said cutting table.

2. The combination of claim 1, wherein said gripping means are further rotatable about a vertical axis so as to rotate the stacks gripped by said gripping means before release onto the belt.

3. The combination of claim 1, wherein said gripping means are of the gripper type for frontally gripping the stacks, said gripper-type gripping means comprising a pair of claws provided with means for releasably clamping the claws together for releasably gripping the stacks.

4. The combination of claim 3, wherein said claws of said gripper-type gripping means are vertically movable between spaces between mutually arranged rules of said longitudinal grip, and wherein said conveyor belt comprises a central gap in which said claws of said gripper-type gripping means are arrangeable.

5. The combination of claim 3, wherein said gripper-type gripping means comprise:

a plate;

a lower claw which is fixed with an end thereof below said plate;

an abutment being mounted above said plate;

an upper claw abutting with a rear and thereof on said abutment;

a sliding block which is actuated so as to slide vertically above said plate;

a jack having a vertical axis for actuating said sliding block; and a horizontal pivot located below said sliding block to which said upper claw is articulated in a median position thereof.

6. The combination of claim 1, further comprising a longitudinal grid of mutually parallel and spaced rulers arranged adjacent said outlet edge of said cutting table for supporting said stacks of pattern pieces and between which said gripping means is insertable when said gripping means moves up and down in said vertical direction for facilitating the removal of said stacks from the mat by said gripping means, and longitudinal grid of mutually parallel and spaced rulers being oscillatable about an axis extending parallel to the extension of said outlet edge of said cutting table, and wherein said rulers of said longitudinal grid are provided with freely rotating end pulleys with respective secondary belts being wound on said end pulleys, and with further pulleys, said secondary belts being closed in a loop and being wound around said further pulleys, said secondary belts being windable about an end portion of a mat conveyor belt of said cutting table when said supporting framework is arranged adjacent said edge of said cutting table.

7. A method for cutting a mat of plies of fabric and removing stacks of cut pattern pieces from the mat, comprising the steps of:

perimetrically cutting contours of various pattern pieces on the mat of plies of fabric supported on a cutting table to form mutually separate stacks of cut pattern pieces which are mutually separate from each other and which are also separate from a residual portion of the mat;

forming additional cuts in the mat which extend in the residual portion of the mat between the contours of said mutually separate stacks of cut pattern pieces to connect the mutually separate stacks of cut pattern pieces to each other by means of said additional cuts and to edges of the mat such that said additional cuts reduce said residual portion of the mat to small and mutually separate residual portions for facilitating removal of said stacks of cut pattern pieces from the mat;

moving the mat in an advancement direction towards an outlet side of said cutting table such that said stacks of cut pattern pieces exit from said cutting table at said outlet side of said cutting table;

removing said cut pattern pieces which have exited from said cutting table at said outlet side of said cutting table by engaging and gripping said cut pattern pieces simultaneously at top and bottom surfaces of said cut pattern pieces simultaneously at top and bottom surfaces of said cut pattern pieces by means of a gripper device which engages and grips said cut pattern pieces at said top and bottom surfaces thereof.

8. The method according to claim 1, comprising forming said additional cuts such that said additional cuts are distributed in an orderly fashion in a grid pattern.

9. The method according to claim 8, further comprising defining a grip point for each of said stacks of cut pattern pieces.

10. The method according to claim 9, further comprising the steps of:

automatically processing data related to said additional cuts distributed in a grid pattern and to said stack grip points starting from data defined for controlling cutting of said mat; and producing a sequence of coordinated instructions for controlling the cutting and stack removal.

11. The method according to claim 1, further comprising the steps of:

covering said mat with a covering film made of a material selected from any of a plastic and a paper material before the step of perimetrically cutting contours of various pattern pieces; and forming a perimetric cut of the mat which allows to recover edges of the covering film.

12. The method of claim 7, further comprising transferring said cut pattern pieces engaged and gripped by said gripper device by means of moving said gripper device to a conveyor arranged adjacent said outlet side of said cutting table, and releasing said gripper device to release said cut pattern pieces from said gripper device on to said conveyor and conveying the released cut pattern pieces on said conveyor.

* * * * *